United States Patent [19]

Wolff

[11] Patent Number: 5,015,565

[45] Date of Patent: May 14, 1991

[54] COLOR PHOTOGRAPHIC RECORDING MATERIAL

[75] Inventor: Erich Wolff, Solingen, Fed. Rep. of Germany

[73] Assignee: Agfa Gevaert Aktiengesellschaft, Leverkusen-Bayerwerk, Fed. Rep. of Germany

[21] Appl. No.: 354,503

[22] Filed: May 19, 1989

[30] Foreign Application Priority Data

Jun. 4, 1988 [DE] Fed. Rep. of Germany ..... 3819051

[51] Int. Cl.[5] ..... G03C 1/08; G03C 7/32

[52] U.S. Cl. ..... 430/552; 430/553

[58] Field of Search ..... 430/552, 553

[56] References Cited

FOREIGN PATENT DOCUMENTS 0295632 12/1988 European Pat. Off. ..... 430/553

*Primary Examiner*—Charles L. Bowers, Jr.
*Assistant Examiner*—Janet C. Baxter
*Attorney, Agent, or Firm*—Connolly and Hutz

[57] ABSTRACT

A color photographic recording material comprising at least one silver halide emulsion layer and a naphtholic cyan coupler corresponding to formula I (I)

in which

Q is a 5-, 6- or 7-membered heterocyclic radical;

S is a substituent which, in the 6-position of the naphthol ring, can form a fused heterocyclic ring with Y;

l is 0, 1, 2 or 3;

X represents H or a group releasable during color coupling which is capable of forming a fused heterocyclic ring with Y;

Y represents —Z—$R^1$ or —NH—$R^2$;

Z represents —O—, —$S(O)_m$— or —$SO_2$—NH—;

m is 0, 1 or 2;

$R^1$ represents H, $CF_3$, alkyl, aryl or a heterocyclic radical;

$R^2$ represents H or a monofunctional radical containing at least one carbon atom which is capable of forming a fused heterocyclic ring with X or with S (in the 6-position of the naphthol ring), gives a cyan dye image on chromogenic development with desired absorption at approximately 700 nm, good dark fading stability and high reproducibility, even where spent bleaching baths are used.

3 Claims, 9 Drawing Sheets

COLOR PHOTOGRAPHIC RECORDING MATERIAL

INTRODUCTION

This invention relates to a color photographic recording material comprising new co-emulsified naphtholic cyan couplers.

BACKGROUND OF THE INVENTION

It is known that colored photographic images can be produced by chromogenic development, i.e. by development of silver halide emulsion layers which have been exposed to form an image with suitable dye-producing developer substances (so-called color developers) in the presence of suitable color couplers, the developer oxidation product formed in accordance with the silver image reacting with the color coupler to form a dye image. The color couplers used are normally aromatic compounds containing primary amino groups, more especially of the p-phenylenediamine type.

In practice, color couplers and the dyes produced therefrom by chromogenic development have to satisfy a number of requirements. Thus, the rate at which the color couplers couple with the oxidation product of the color developer should be as high as possible. The color couplers and the dyes obtained therefrom should show adequate stability to light, elevated temperature and moisture. This applies both to fresh material and also to processed material. For example, the residual coupler still present in the white parts of the processed material should not turn yellow. In addition, the dyes should show adequate stability to gaseous reducing or oxidizing agents. In addition, they should be anchored in non-diffusing form in the image layer and should be deposited in fine-grained form during the chromogenic development process. The mechanical properties of the layers should not be adversely affected by the color couplers. Finally, the dyes formed from the color couplers during the chromogenic development process should show a favorable absorption curve with a maximum which corresponds to the color of the particular component image required and minimal secondary absorptions. Thus, in the ideal case, a cyan dye should absorb red light almost completely while allowing most green and blue light through. In addition, the absorption maxima of the dyes both in color reversal films and in color negative films should substantially correspond to the sensitization maxima of the color paper materials used for copying.

Compounds derived from phenol or α-naphthol are generally used as cyan couplers, i.e. as color couplers suitable for producing the cyan component image. Although naphtholic cyan couplers give dyes with substantially ideal absorption for color negative films (absorption maximum at approximately 700 nm), they show very poor dark-fading behavior, i.e. the cyan component image formed during development fades to a considerable extent in the event of longterm storage or in an accelerated test at elevated temperature, resulting in reddening of the copy or in a density-dependent color tinge.

Naphtholic cyan couplers containing a heterocyclic substituent in the 2-position are also known from a number of patent specifications (DDR 5567, DDR 5906, U.S. Pat. Nos. 2,373,821, 2,530,349, 2,545,687, 2,545,307, DE-B-1 009 923, FR-A-878 943).

These compounds are also characterized by good absorption of the dyes produced therefrom with a maximum at approximately 700 nm and, in particular, by high permeability in the green spectral region.

Benzthiazoles, benzoxazoles and benzimidazoles are mentioned as examples of heterocyclic substituents in the 2-position.

In addition, other photographically important groups, such as for example solubilizing groups and/or ballast groups, may be arranged in the heterocyclic radical.

The disadvantage of all these compounds lies in the poor re-oxidizability of the leuco dyes intermediately formed, particularly in spent bleaching or bleach-fixing baths or in atypically prepared bleaching or bleach-fixing baths. This results in a considerable reduction in the maximum obtainable density, for example when the bleaching time is shortened, when the pH is changed or when developers, are carried over.

SUMMARY OF THE INVENTION

The present invention relates to a color photographic recording material comprising at least one photosensitive silver halide emulsion layer and, associated therewith, a naphtholic cyan coupler corresponding to formula I

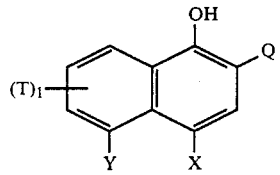

(I)

in which

O is a 5-, 6- or 7-membered heterocyclic radical;

T is a substituent which, when it is in the 6-position of the naphthol ring, can form a fused heterocyclic ring with Y;

l is 0, 1, 2 or 3;

X represents H or a group releasable during the color coupling reaction which may form a fused heterocyclic ring with Y;

Y represents $—Z—R^1$ or $—NH—R^2$;

Z represents —O—, $—S(O)_m—$ or $—SO_2NH—$;

m is 0, 1 or 2;

$R^1$ represents H, $CF_3$, alkyl, aryl or a heterocyclic radical;

$R^2$ represents H or a monofunctional radical containing at least one hydrocarbon radical which may form a fused heterocyclic ring with X or with S (in the 6-position of the naphthol ring).

The heterocyclic radical Q is a heterocyclic ring containing at least one heteroatom (O, S, N, P) which may be attached to the naphthol ring, for example by a carbon atom or by a nitrogen atom. The heterocyclic radical may contain a benzene ring fused onto the heterocyclic ring and may contain further substituents on the heterocyclic ring and/or on the fused benzene ring, including for example hydroxyl, halogen, alkyl, aralkyl, aryl, alkoxy, alkylthio, alkylsulfonyl, arylsulfonyl, acylamino, alkoxycarbonyl, carbamoyl, sulfamoyl.

The heterocyclic radical Q is, for example, one of the following radicals attached to the naphthol ring by a ring carbon atom or ring nitrogen atom of the heterocyclic ring: pyrrole, indole, oxazole, benzoxazole, thiazole, benzthiazole, imidazole, benzimidazole, triazole, benzotriazole, thiadiazole, oxadiazole, pyrazolone, tetrahydrofuran, tetrahydropyrene, morpholine, diazine, triazine, benzodiazinone.

A substituent represented by T is, for example, halogen, alkyl, alkoxy, acylamino, sulfamoyl, acyloxy, $CF_3$.

An alkyl radical represented by $R^1$ contains, for example, from 1 to 18 carbon atoms. Examples are methyl, butyl, t-butyl, dodecyl, hexadecyl. An aryl radical represented by $R^1$ is, in particular, phenyl, optionally substituted, for example, by halogen, alkyl, alkoxy, amino, substituted amino, sulfonyl, alkoxycarbonyl, sulfamoyl.

A heterocyclic radical represented by $R^1$ is, for example, a pyridine radical, tetrazole radical, imidazole radical, triazole radical.

A radical represented by $R^2$ is, in particular, an acyl radical which may be intramolecularly attached to S (in the 6-position of the naphthol ring) or to X, so that a fused heterocyclic ring is formed. The acyl radical may be derived from an aliphatic or aromatic carboxylic acid or sulfonic acid or from a carbonic acid semiester or from an aliphatically or aromatically substituted carbamic or sulfamic acid or phosphorus-containing acid. The following are examples of such acyl radicals:

$-CO-R^3$, $-CO-OR^3$, $-SO_2-R^3$, $-CO-NH-R^3$, $-CO-NR^3-R^3$, $-SO_2-NH-R^3$, $SO_2-NR^3-R^3$, $-PO[-(O)_n-R^3]_2$, in which $R^3$ is alkyl or aryl and n=0 or 1 or in which two substituents $R^3$ present in an acyl radical are not necessarily identical and in which two substituents $R^3$ present in an acyl radical may form a heterocyclic ring.

A group X releasable during color coupling is, for example, a halogen atom, such as F, Cl or Br, or an organic group attached through an oxygen atom, a sulfur atom or a nitrogen atom. Suitable releasable groups are, for example, optionally substituted alkoxy, aroxy, arylthio, heterocyclic thio and arylazo groups.

DETAILED DESCRIPTION

The following are examples of cyan couplers of formula I according to the invention:

C-1

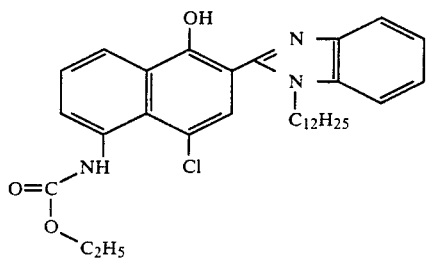

C-2

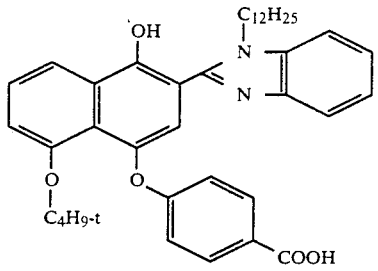

C-3

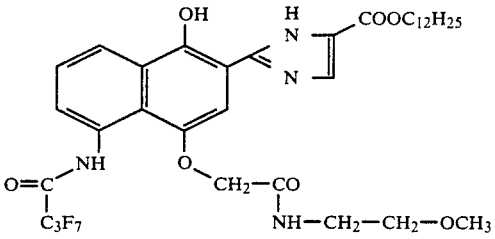

C-4

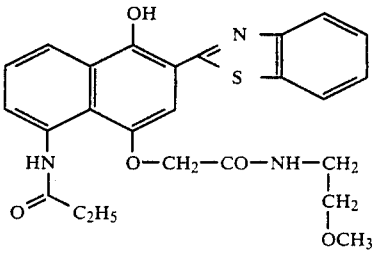

-continued
C-5
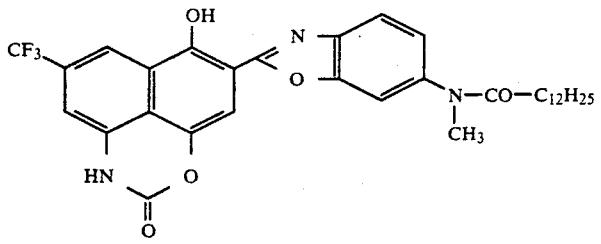
C-6
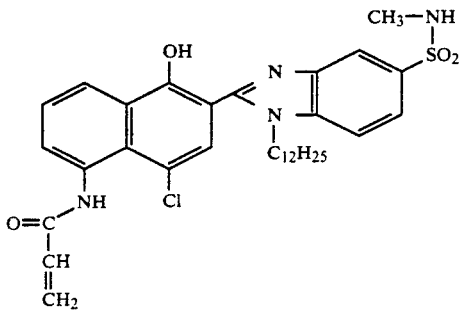
C-7
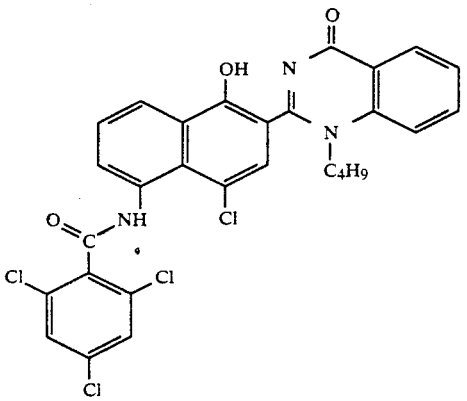
C-8
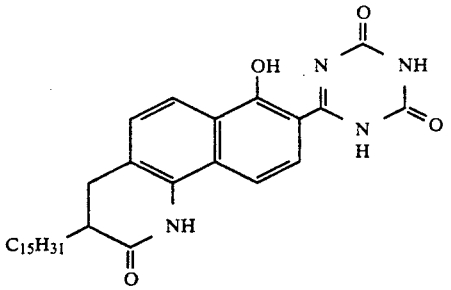
C-9
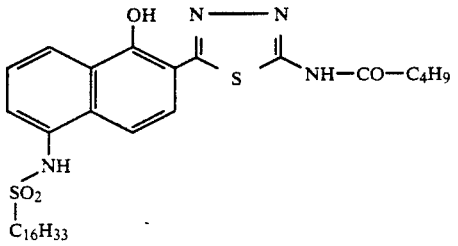

-continued
C-10
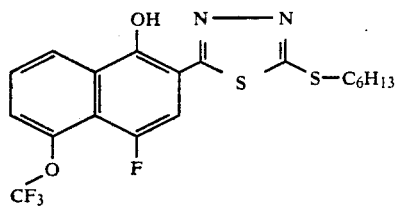
C-11
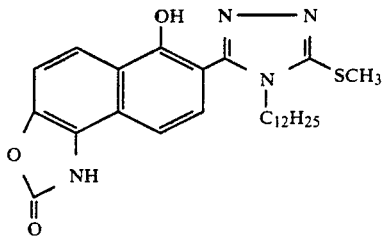
C-12
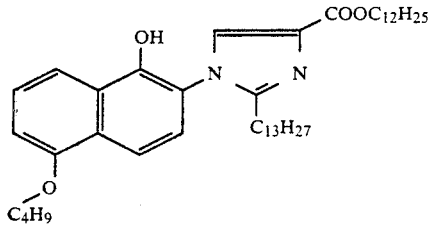
C-13
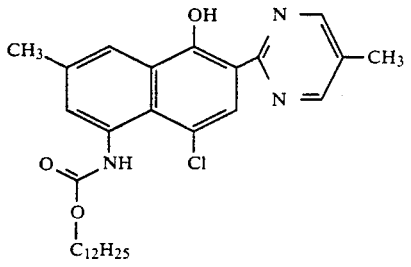
C-14
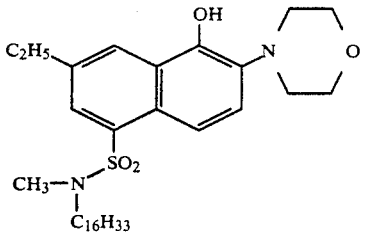
C-15
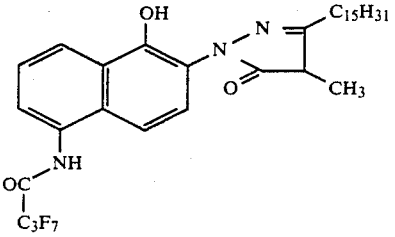

-continued
C-16
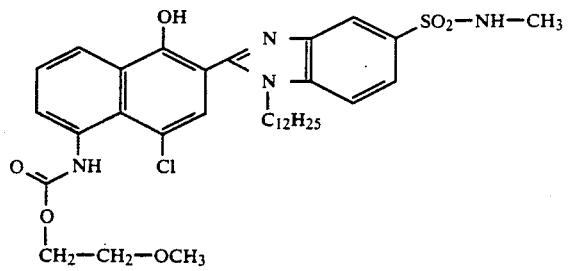
C-17
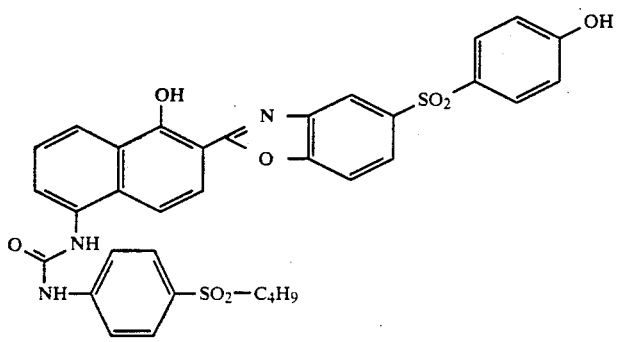
C-18
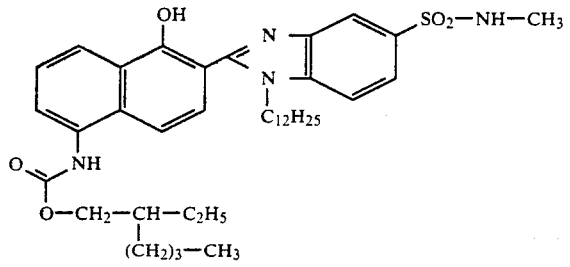
C-19
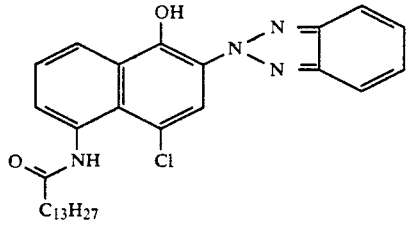
C-20
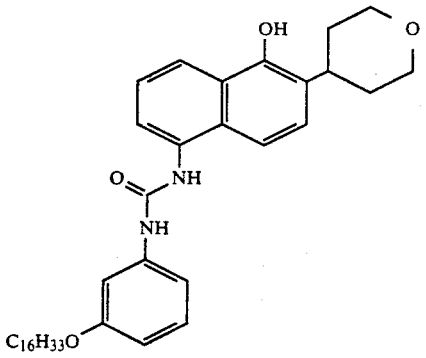
C-21
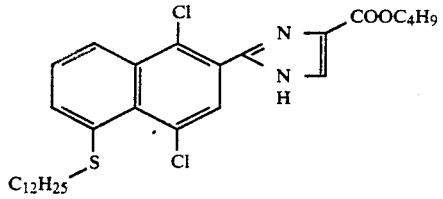

-continued

C-22

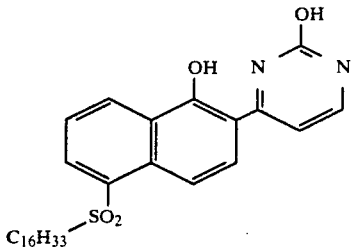

C-23

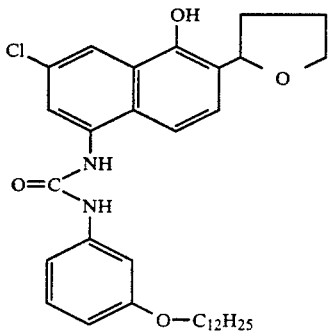

Coupler C-16 is prepared, for example, as follows:

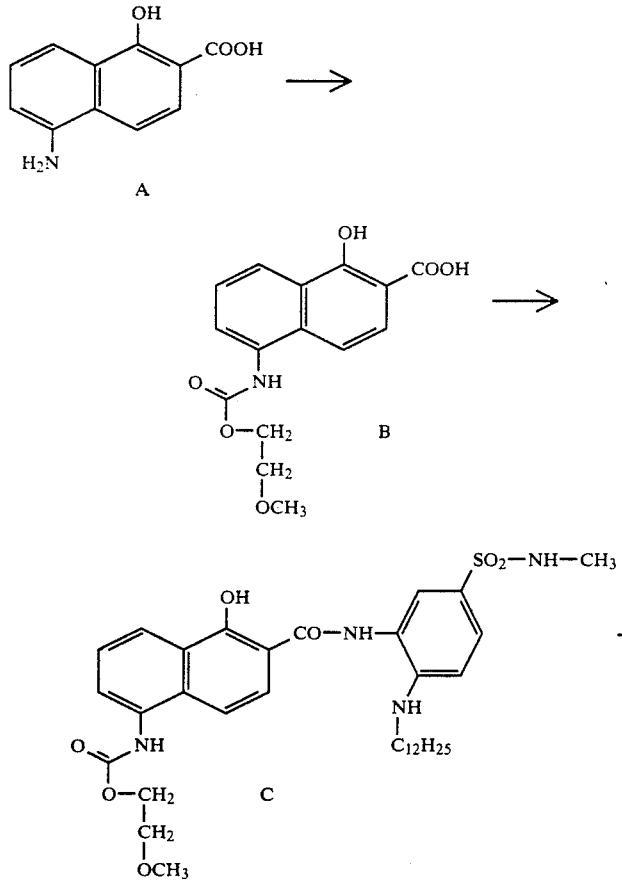

Compound B 60 g 5-amino-1-naphthol-2-carboxylic acid are heated to 60° C. in 500 ml dimethyl acetamide and 41 g methoxyethyl chloroformate slowly added.

On completion of the reaction, the reaction product is precipitated in 5 liters ice/water, filtered under suction and washed with acetonitrile until the washing liquid running off is clear.

52 g compound B; Mp. 210° C. (decomposition).

Compound C 52 g compound B and 63 g 2-dodecylamino-5-methylaminosulfonyl aniline are heated to 50° C. in 500 ml dioxane, followed by the addition in portions of 39 g dicyclohexyl carbodiimide. On completion of the reaction, the dicyclohexyl urea precipitated is filtered off under suction and the filtrate is precipitated in 4 liters ice/water.

Recrystallization from ether gives 50 g of compound C melting at 151° to 153° C.

Coupler C-16

50 g compound C are heated to boiling temperature in 500 ml glacial acetic acid. On completion of the reaction, the reaction product is thoroughly stirred in 5 liters ice/water. After the addition of 1000 ml ethyl acetate, the organic phase is separated off, dried over $CaCl_2$ and concentrated in a rotary evaporator. The residue is recrystallized from methanol.

Yield: 33 g coupler C-16; Mp: 142°-144° C.

Coupler C-18 is prepared as follows:

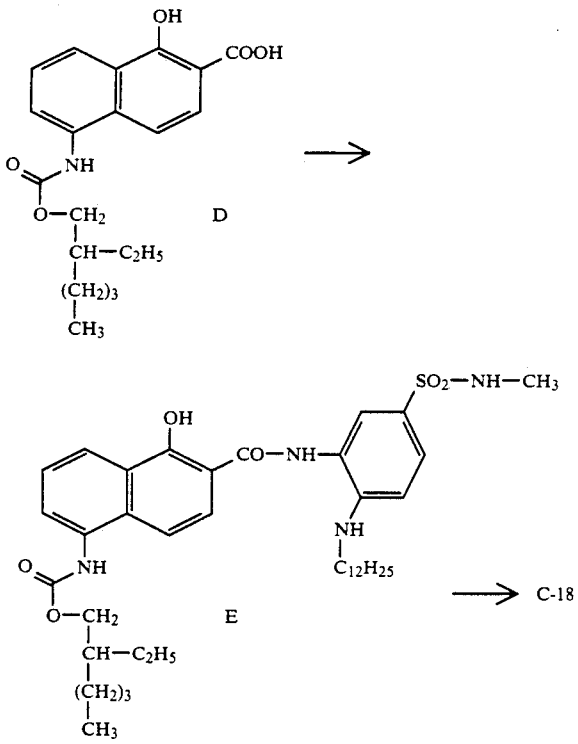

Compound D 60 g 5-amino-1-naphthol-2-carboxylic acid are heated in 500 ml dimethyl acetamide and 57 g 2-ethyl hexyl chlorocarbonic acid ester slowly added. After stirring for 30 minutes, the product is precipitated in 5 liters ice/water, filtered under suction, washed with acetonitrile and then dried.

Yield: 63 g; Mp: 178° C.

Compound E 63 g of compound D and 65 g 2-dodecylamino-5-methylaminosulfonyl aniline are heated to 50° C. in 500 ml dioxane, followed by the addition in portions of 40 g dicyclohexyl carbodiimide. On completion of the reaction, the dicyclohexyl urea precipitated is filtered off under suction, the filtrate is precipitated in 3 liters ice/water and the product precipitated is filtered off under suction.

Recrystallization from acetonitrile gives 37 g of E melting at 128°-130° C.

Coupler C-18

37 g compound E are heated to boiling temperature in 400 ml glacial acetic acid. On completion of the reaction, the reaction product is precipitated in 5 liters ice/water, filtered under suction, washed with water and recrystallized from acetonitrile.

Yield: 31 g coupler C-18; Mp.: 160° C.

The leuco dyes intermediately formed during color coupling from the naphtholic cyan couplers according to the invention are very much easier to oxidize to the corresponding cyan dyes and, accordingly, are considerably less sensitive to variations in the conditions prevailing during the bleaching process.

In addition, the couplers according to the invention are distinguished by excellent dark fading behavior, i.e. by the stability of the final image dye during storage in darkness.

In addition, the color couplers according to the invention by virtue of their excellent solubility in high-boiling organic solvents, form very stable, finely divided dispersions of high coupling activity which show no increase in particle size, even in the event of prolonged cool storage or prolonged digestion at 50° C. The compounds according to the invention show no tendency towards crystallization, even in final layers and multilayer combinations.

The absorption maxima of the dyes obtained from the color couplers according to the invention by reaction with oxidized p-phenylene derivatives lie in the photographically optimal range with steep sides to the red or infrared spectral region. The half bandwidths of the dyes are decidedly narrow, in addition to which the dyes show high stability to UV light.

In the production of the photosensitive color photographic recording material according to the invention, the non-diffusing cyan couplers corresponding to formula I may be incorporated in known manner in the casting solution of the silver halide emulsion layers or other colloid layers. For example, the preferably oil-soluble or hydrophobic couplers may be added to a hydrophilic colloid solution, preferably from a solution in a suitable coupler solvent (oil former), optionally in the presence of a wetting agent or dispersant. The hydrophilic casting solution may of course contain other standard additives in addition to the binder. The solution of the coupler does not have to be directly dispersed in the casting solution for the silver halide emulsion layer or any other water-permeable layer. Instead, it may even be initially dispersed with advantage in an aqueous non-photosensitive solution of a hydrophilic colloid, after which the mixture obtained is mixed with the casting solution for the photosensitive silver halide emulsion layer or any other water-permeable layer before application, optionally after removal of the low-boiling organic solvent used.

The photosensitive silver halide emulsions used may contain as halide chloride, bromide and iodide or mixtures thereof. In one preferred embodiment, 0 to 12 mol-% of the halide component of at least one layer consists of iodide, 0 to 50 mol-% of chloride and 50 to 100 mol-% of bromide. In one preferred embodiment, the silver halide may consist of predominantly compact crystals which may have, for example, a cubic or octahedral form or transitional forms and which generally have a mean grain size of more than 0.2 μm. The average diameter-to-thickness ratio is preferably less than 8:1, the diameter of a crystal being defined as the diameter of a circle with an area corresponding to the projected area of the crystal. In another preferred embodiment, however, all the emulsions or individual emulsions may also comprise essentially platy silver halide crystals in which the diameter-to-thickness ratio is greater than 8:1. The emulsions may be monodisperse emulsions which preferably have a mean grain size of 0.3 μm to 1.2 μm. The silver halide crystals may have a multilayer structure.

Suitable protective colloids or binders for the layers of the recording material are the usual hydrophilic film-forming agents, for example proteins, particularly gelatine. However, the gelatine may be completely or partly replaced by other natural or synthetic binders. Casting aids and plasticizers may be used, cf. Research Disclosure 17 643 (December 1978), particularly Chapters IX, XI and XII.

The emulsions may be chemically or spectrally sensitized in the usual way and may be stabilized with the usual silver halide stabilizers. The emulsion layers and other non-photosensitive layers may be hardened in the usual way with known hardeners. Suitable chemical sensitizers, spectral sensitizing dyes, stabilizers and hardeners are described, for example, in Research Disclosure 17 643, cf. in particular Chapters III, IV, VI and X.

Color photographic recording materials normally contain at least one silver halide emulsion layer for recording light of each of the three spectral regions red, green and blue. To this end, the photosensitive layers are spectrally sensitized in known manner by suitable sensitizing dyes. Blue-sensitive silver halide emulsion layers need not necessarily contain a spectral sensitizer because, in many cases, the natural sensitivity of the silver halide is sufficient for recording blue light.

Each of the photosensitive layers mentioned may consist of a single layer or, in known manner, for example as in the so-called double layer arrangement, may also comprise two or even more partial silver halide emulsion layers (DE-C-1 121 470). Normally, red-sensitive silver halide emulsion layers are arranged nearer the layer support than green-sensitive silver halide emulsion layers which in turn are arranged nearer than blue-sensitive emulsion layers, a non-photosensitive yellow filter layer generally being arranged between the green-sensitive layers and blue-sensitive layers. However, other arrangements are also possible. A non-photosensitive intermediate layer, which may contain agents to prevent the unwanted diffusion of developer oxidation products, is generally arranged between layers of different spectral sensitivity. Where several silver halide emulsion layers of the same spectral sensitivity are present, they may be arranged immediately adjacent one another or in such a way that a photosensitive layer of different spectral sensitivity is present between them (DE-A-1 958 709, DE-A-25 30 645, DE-A-26 22 922). Partial silver halide layers such as these of the same spectral sensitivity generally show different sensitivity to light (speed), the more sensitive partial layers generally being arranged further away from the layer support than less sensitive partial layers of the same spectral sensitivity.

Color photographic recording materials for the production of multicolor images normally contain dye-producing compounds, in the present case particularly color couplers, for producing the different component dye images cyan, magenta and yellow in spatial and spectral association with the silver halide emulsion layers of different spectral sensitivity.

In the context of the invention, spatial association means that the color coupler is present in such a spatial relationship to the silver halide emulsion layer that the two are capable of interacting in such a way as to allow imagewise accordance between the silver image formed during development and the dye image produced from the color coupler. This result is generally achieved by the fact that the color coupler is contained in the silver halide emulsion layer itself or in an adjacent, optionally non-photosensitive binder layer.

By spectral association is meant that the spectral sensitivity of each of the photosensitive silver halide emulsion layers and the color of the component dye image produced from the particular spatially associated color coupler bear a certain relationship to one another, a component dye image relating to another color (generally for example the colors cyan, magenta or yellow in that order) being associated with each of the spectral sensitivities (red, green, blue).

One or more color couplers may be associated with each of the differently spectrally sensitized silver halide emulsion layers. Where several silver halide emulsion layers of the same spectral sensitivity are present, each of them may contain a color coupler, the color couplers in question not necessarily having to be the same. They are merely required to produce at least substantially the same color during color development, normally a color which is complementary to the color of the light to which the silver halide emulsion layers in question are predominantly sensitive.

In preferred embodiments, therefore, at least one non-diffusing color coupler for producing the cyan component dye image, in the present case at least one colorless cyan coupler corresponding to formula I, is associated with red-sensitive silver halide emulsion layers. At least one non-diffusing color coupler for producing the magenta component dye image, normally a color coupler of the 5-pyrazolone type, the indazolone type or any of the various pyrazoloazoles, is associated with green-sensitive silver halide emulsion layers; pyrazoloazoles of the type in question are described, for example, in DE-A-35 16 996. Finally, at least one non-diffusing color coupler for producing the yellow component dye image, generally a color coupler containing an open-chain ketomethylene group, is associated with blue-sensitive silver halide emulsion layers. Color couplers of this type are known in large numbers and are described in a number of patent specifications. Reference is made here, for example, to the publications entitled "Farbkuppler (Color Couplers)" by W. PELZ in "Mitteilungen aus den Forschungslaboratorien der Agfa, Leverkusen/München", Vol. III, page 111 (1961) and by K VENKATARAMAN in "The Chemistry of Synthetic Dyes", Vol. 4, 341 to 387, Academic Press (1971).

The color couplers may be both typical 4-equivalent couplers and also 2-equivalent couplers in which a smaller quantity of silver halide is required for dye production. 2-Equivalent couplers are known to be derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced. Couplers of the latter type may also be additionally present in the photosensitive silver halide emulsion layers where they serve as mask couplers to compensate the unwanted secondary densities of the image dyes. However, 2-equivalent couplers also include the known white couplers, although couplers such as these do not produce a dye on reaction with color developer oxidation products. 2-Equivalent couplers also include the known DIR, DAR and FAR couplers, i.e. couplers which, in the coupling position, contain a releasable group which is released as a diffusing development inhibitor, development accelerator or diffusing fogging agent on reaction with developer oxidation products. The couplers, including the compounds of formula I used in accordance with the invention, may also be used in polymeric form, for example as a polymer latex.

High molecular weight color couplers are described, for example, in DE-C-1 297 417, DE-A-24 07 569, DE-A-31 48 I25, DE-A-32 17 200, DE-A-33 20 079, DE-A-33 24 932, DE-A-33 3I 743, DE-A-33 40 376, EP-A-27 284, US-A-4,080,211. The high molecular weight color couplers are generally produced by polymerization of ethylenically unsaturated monomeric color couplers.

The color couplers used may also be those which give dyes having slight or limited mobility.

By slight or limited mobility is meant a mobility which is gauged in such a way that the contours of the discrete dye patches formed during chromogenic development blend and merge with one another. This degree of mobility should be distinguished, on the one hand, from the usual case of complete immobility in photographic layers which, in conventional photographic recording materials, is required for the color couplers or rather for the dyes produced therefrom in order to obtain maximal definition and, on the other hand, from the case of total mobility of the dyes as required, for example, in dye diffusion processes. The last-mentioned dyes generally have at least one group which makes them soluble in the alkaline medium. The extent of the slight mobility required in accordance with the invention may be controlled by variation of substituents in order, for example, specifically to influence solubility in the organic medium of the oil former or affinity for the binder matrix.

In addition to the constituents mentioned above, the color photographic recording material according to the invention may contain other additives, such as for example antioxidants, dye stabilizers and agents for influencing the mechanical and electrostatic properties. In order to reduce or avoid the adverse effect of UV light on the dye images produced with the color photographic recording material according to the invention, it is of advantage for example to use UV absorbers in one or more of the layers present in the recording material, preferably in one of the upper layers. Suitable UV absorbers are described, for example, in US-A-3,253,921, in DE-C-2 036 719 and in EP-A-0 057 160.

To produce color photographic images, the color photographic recording material according to the invention, which contains at least one silver halide emulsion layer and at least one coupler of formula I associated therewith, is developed with a color developer compound. Suitable color developer compounds are any developer compounds which are capable of reacting with color couplers in the form of their oxidation product to form azomethine dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methylsulfonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine.

Other useful color developers are described, for example, in J. Amer. Chem. Soc. 73, 3100 (1951) and in G. Haist, Modern Photographic Processing, 1979, John Wiley and Sons, New York, pages 545 et seq.

After color development, the material is bleached and fixed in the usual way. Bleaching and fixing may be carried out separately or even together with one another. Suitable bleaches are any of the usual compounds, for example $Fe^{3+}$ salts and $Fe^{3+}$ complex salts, such as ferricyanides, dichromates, water-soluble cobalt complexes, etc. Particular preference is attributed to iron(III) complexes of aminopolycarboxylic acids, more especially for example ethylenediamine tetraacetic acid, N-hydroxyethyl ethylenediamine triacetic acid, alkyliminodicarboxylic acids and of corresponding phosphonic acids. Persulfates are also suitable bleaches.

EXAMPLE 1

100 g coupler are dissolved together with 100 g tricresyl phosphate in 300 ml ethyl acetate at 50° C. and the resulting solution stirred into 1.3 l of a 7.5% by weight aqueous gelatine solution, likewise heated to 50° C., using a high-speed mixer. The ethyl acetate is then evaporated off at 80 mmHg. The resulting dispersion is left to solidify and is stored at 6° C.

0.045 mol cyan coupler in the form of the described dispersion is added to 1 kg of a red-sensitized silver bromide iodide emulsion containing 5 mol-% iodide (Ag content as $AgNO_3$: 129 g/kg; gelatine content 45 g/kg). The mixture was then applied to a cellulose triacetate film with an Ag application of 3.2 g $AgNO_3/m^2$. After hardening, the corresponding material was exposed behind a graduated grey wedge and processed in the developer described in E. Ch. Gehret, British J. of Photography 1974, page 597.

After color development, samples were introduced first into an acidic stop bath and then, at a defined rate under the control of an immersion mechanism, into the bleaching bath (pH 6) and subsequently fixed. Another sample was processed in the same way, except that the pH value of the bleaching bath had been lowered to 4.9.

Comparison couplers:

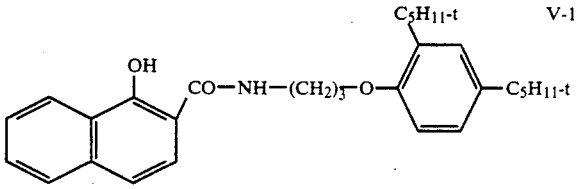

V-1

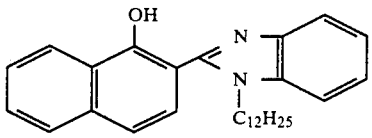

V-2

-continued

Comparison couplers:

V-3

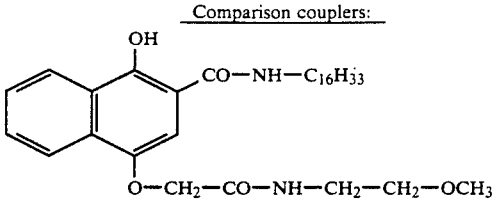

EVALUATION (FIGS. 1 TO 6)

Figure 1:
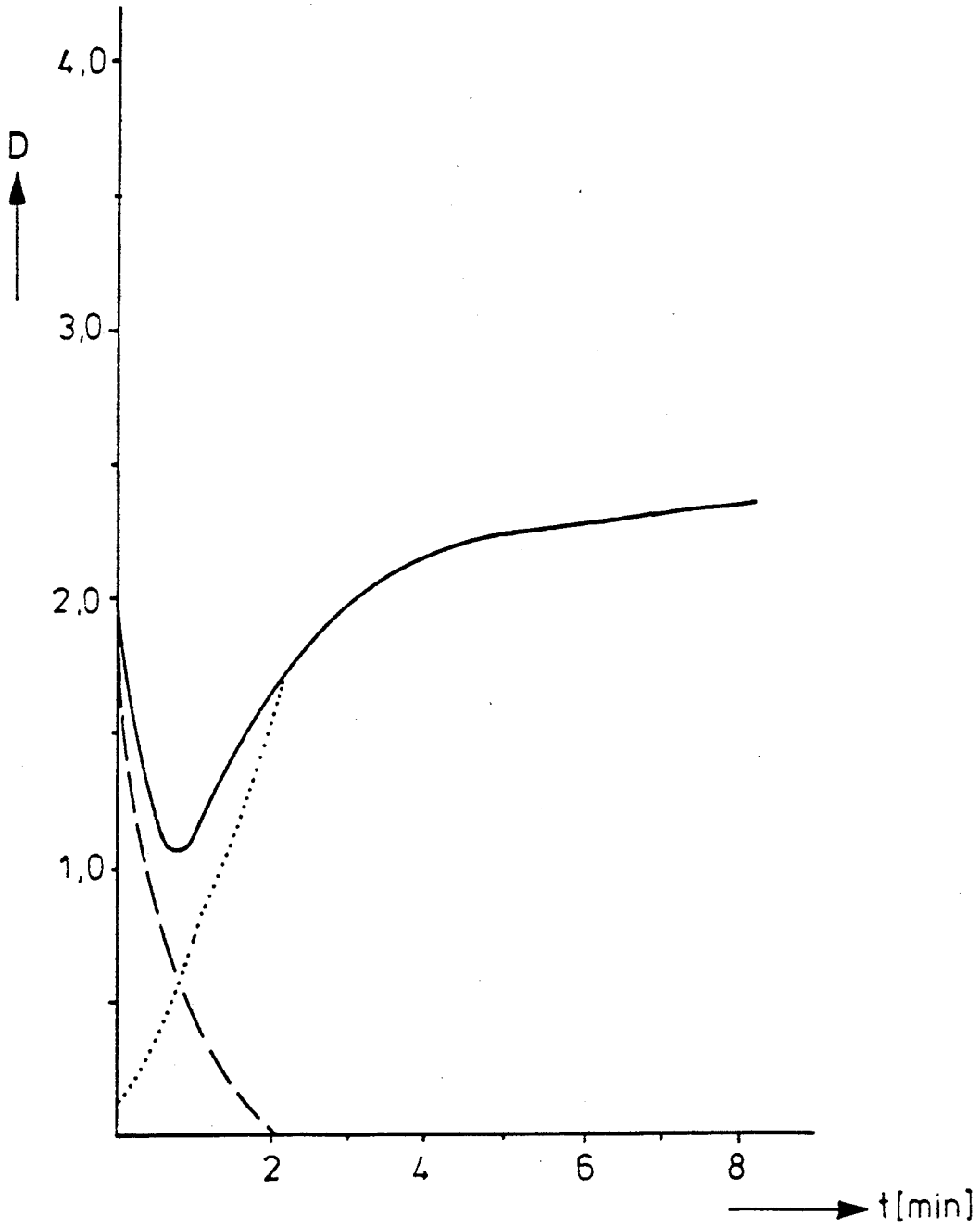
FIGS. 1 2, 3, 4, 5 and 6 are charts of sensitometric curves showing density D plotted on the ordinate and bleaching time on the abscissa.
Figure 2:
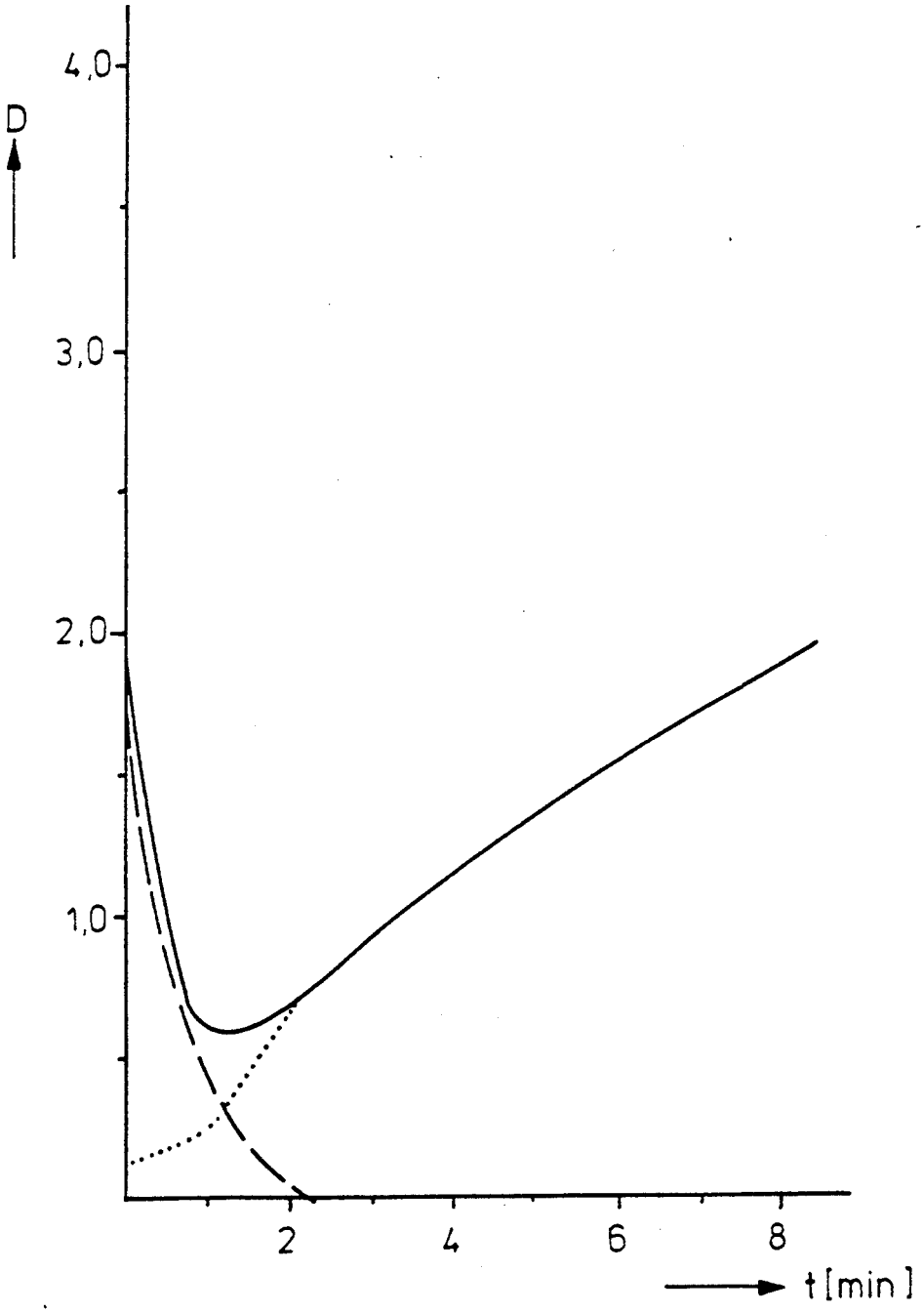
Figure 3:
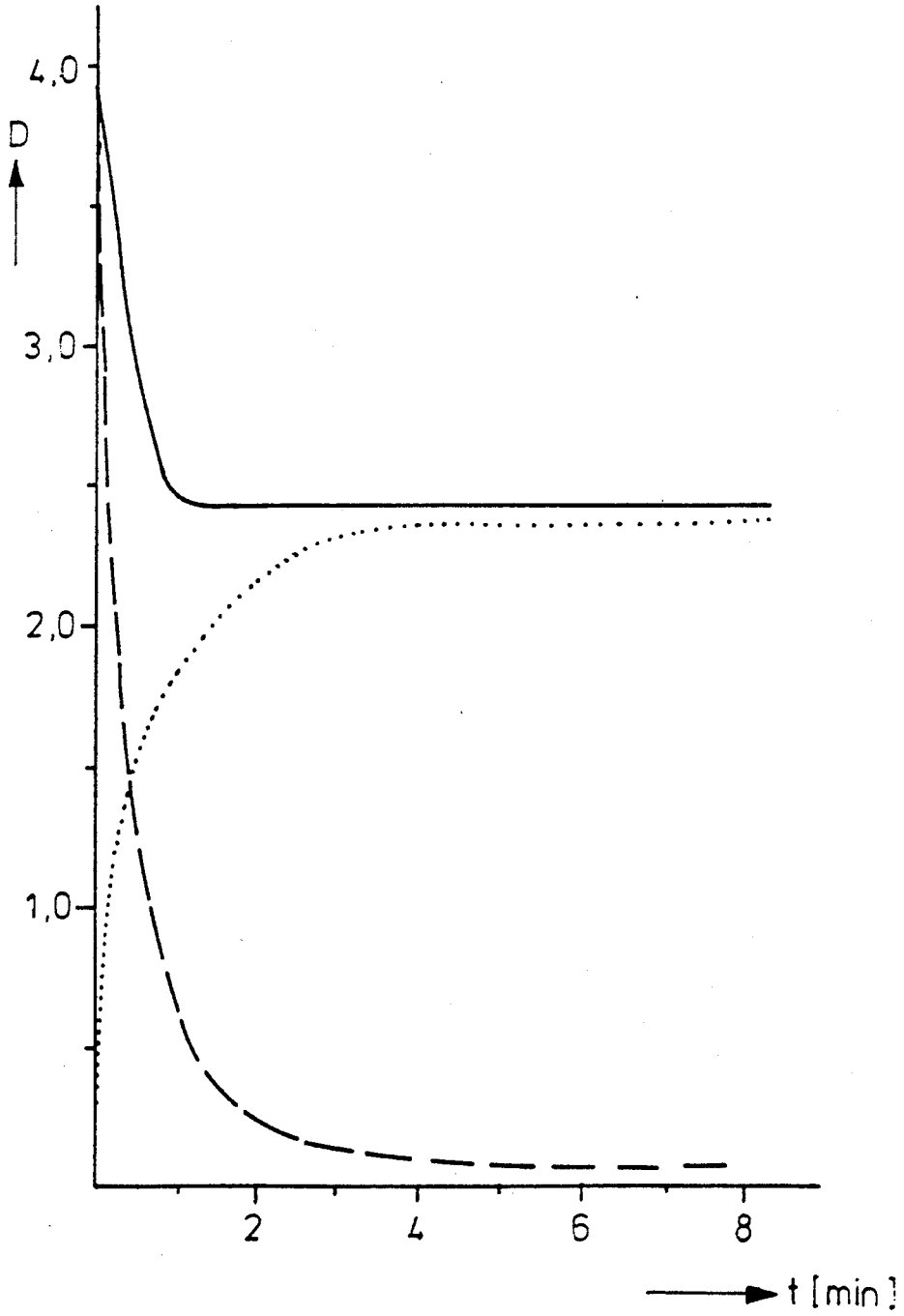
Figure 4:
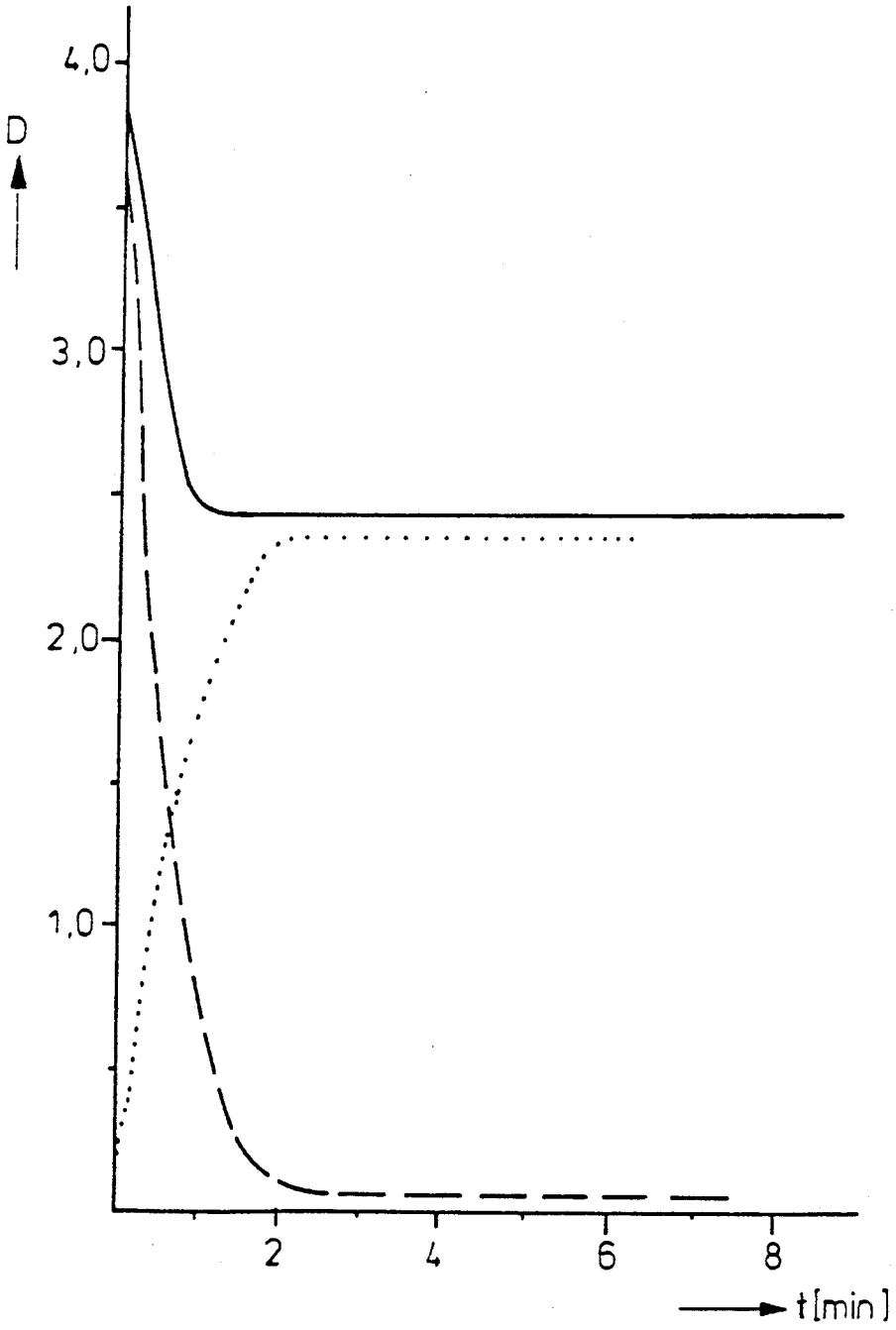
Figure 5:
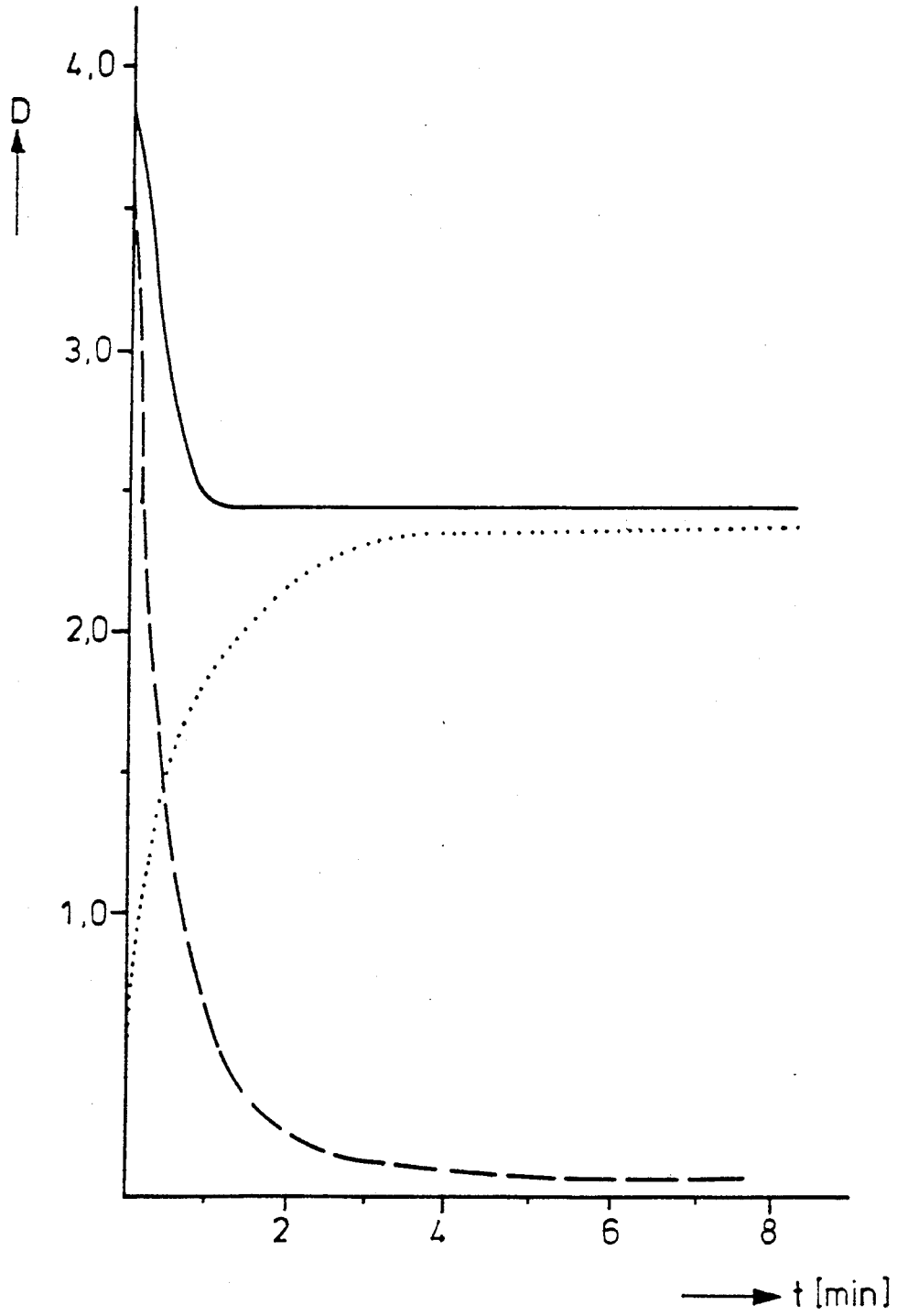
Figure 6:
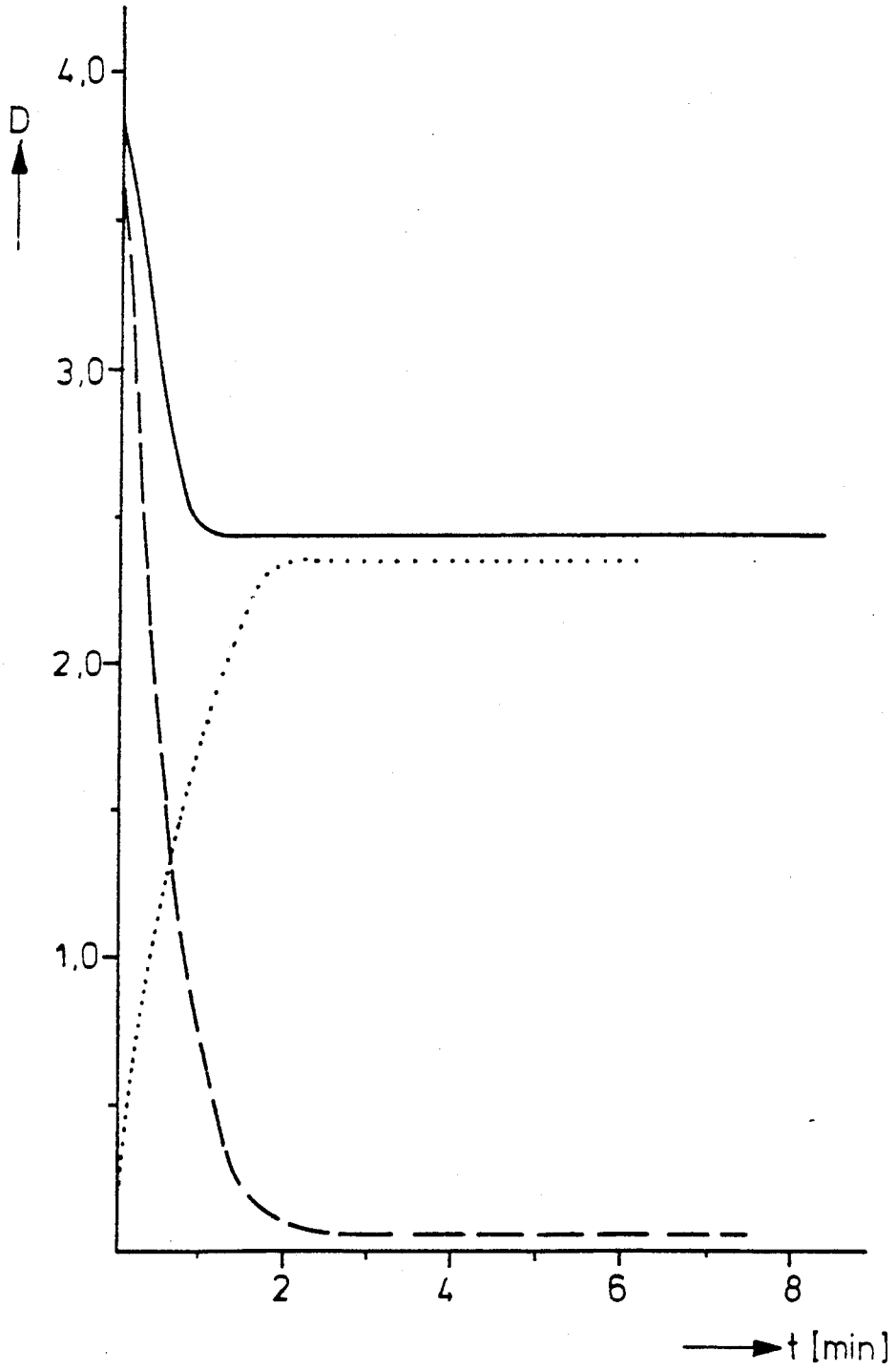

1. Joyce-Gevaert sensitometry with determination of the sum curve of silver density and density of the cyan dye behind a red filter (solid line). The measured density D is plotted as ordinate against the bleaching time (abscissa) in the standard bleaching bath at pH 6.0 (FIGS. 1,3,5)

at pH 4.9 (FIGS. 2,4,6).

2. Determination of the silver density curve behind a blue filter (chain-line curve). The end point of bleaching was also monitored by X-ray fluorescence spectroscopy and was found to be identical with that determined behind a blue filter.

3. Formation of the differential curve of 1. and 2. which reproduces the formation of the cyan dye as a function of time (dotted-line curve).

Assessment

1. In all the samples, the silver is bleached out after 2 minutes.

2. Bleaching of the silver is quicker at pH 4.9 (FIGS. 2, 4, 6) than at pH 6.0 (FIGS. 1, 3, 5).

3. The formation of dye from the couplers C-16 (FIGS. 3, 4) and C-17 (FIGS. 5, 6) according to the invention is complete after only 2 minutes, even in atypical bleaching baths with pH=4.9, whereas the dye obtained from the comparison coupler V-1 (FIGS. 1, 2) has still not reached its final value even after a bleaching time of 3.5 minutes.

The couplers according to the invention enable the bleaching time to be considerably shortened without losing their sensitometric properties.

EXAMPLE 2

Layers of the coupler C-16 according to the invention and of the comparison couplers V-2 and V-3 prepared in accordance with Example 1 are processed after exposure in the same way as described in Example 1 (pH value of the bleaching bath 6.0).

The wedges thus obtained are stored in darkness for 2, 4, 8 and 16 days at 90° C./40% relative humidity, after which the percentage reduction in the maximal color density is determined (Table 1)

TABLE 1

| | Reduction in maximal color density in [%] after | | | |
|---|---|---|---|---|
| Coupler | 2d | 4d | 8d | 16d |
| C-16 | 0 | 0 | 0 | 2 |
| V-2 | 0 | 4 | 9 | 13 |

TABLE 1-continued

| | Reduction in maximal color density in [%] after | | | |
|---|---|---|---|---|
| Coupler | 2d | 4d | 8d | 16d |
| V-3 | 12 | 25 | 38 | 50 |

EXAMPLE 3

A color photographic recording material for color negative development was prepared (material A—according to the invention) by applying the following layers in the order indicated to a transparent layer support of cellulose triacetate. The quantities shown are all based on 1 square meter. For the silver halide applied, the corresponding quantities of $AgNO_3$ are shown. All the silver halide emulsions were stabilized with 0.5 g 4-hydroxy-6-methyl-1,3,3a, 7-tetraazindene per 100 g $AgNO_3$.

Layer 1: (antihalo layer)

black colloidal silver sol containing 0.32 g Ag and 2.2 gelatine.

Layer 2: (intermediate layer)

0.3 g gelatine.

Layer 3: (1st red-sensitized layer)

red-sensitized silver chloride bromide iodide emulsion (5 mol-% iodide; 2 mol-% chloride; mean grain diameter 0.5 μm) of 2.4 g $AgNO_3$ containing 0.9 mol coupler C-16, 0.06 g red mask MR, 0.025 g DIR coupler DC, 1.2 g gelatine.

Layer 4: (2nd red-sensitized layer)

red-sensitized silver chloride bromide iodide emulsion (10 mol-% iodide; mean grain diameter 0.8 μm) of 2.9 g $AgNO_3$ containing 0.25 mmol coupler C-16, 0.02 g red mask MR, 0.04 g DIR compound DIR 1, 1.5 g gelatine.

Layer 5: (intermediate layer)

0.9 g gelatine.

Layer 6: (1st green-sensitized layer)

green-sensitized silver bromide ioide emulsion (5 mol-% iodide) of 2.2 g $AgNO_3$ containing 0.65 g magenta coupler M, 0.04 g DIR coupler DM, 0.02 g yellow mask MG, 1.4 g gelatine.

Layer 7: (2nd green-sensitized layer)

green-sensitized silver bromide iodide emulsion (10 mol-% iodide; mean grain diameter 0.8 μm) of 2.7 g $AgNO_3$ containing 0.17 g magenta coupler M, 0.04 g yellow mask MG, 1.6 g gelatine.

Layer 8: (yellow filter layer)

yellow colloidal silver sol containing 0.07 g Ag and 0.32 g gelatine.

Layer 9: (1st blue-sensitive layer)

silver bromide iodide emulsion (3 mol-% iodide; mean grain diameter 0.3 μm) of 0.95 g $AgNO_3$, with 0.96 g yellow coupler Y, 1.4 g gelatine.

Layer 10: (2nd blue-sensitive layer)

silver bromide iodide emulsion (8 mol-% iodide; mean grain diameter 0.8 μm) of 1.0 g $AgNO_3$ containing 0.22 g yellow coupler Y, 1.6 g gelatine.

Layer 11: (protective layer)

1.1 g gelatine and 0.8 g UV absorber UV-1.

Layer 12: (protective layer)

0.8 g gelatine.

Layer 13: (hardening layer)

0.3 g gelatine and 0.9 g hardener [CAS Reg. no. 65411-60-1].

Comparison materials B and C were prepared in the same way as material A described above, containing comparison couplers V-1 and V-3 instead of C-16 in layers 3 and 4, respectively.

Figure 7:
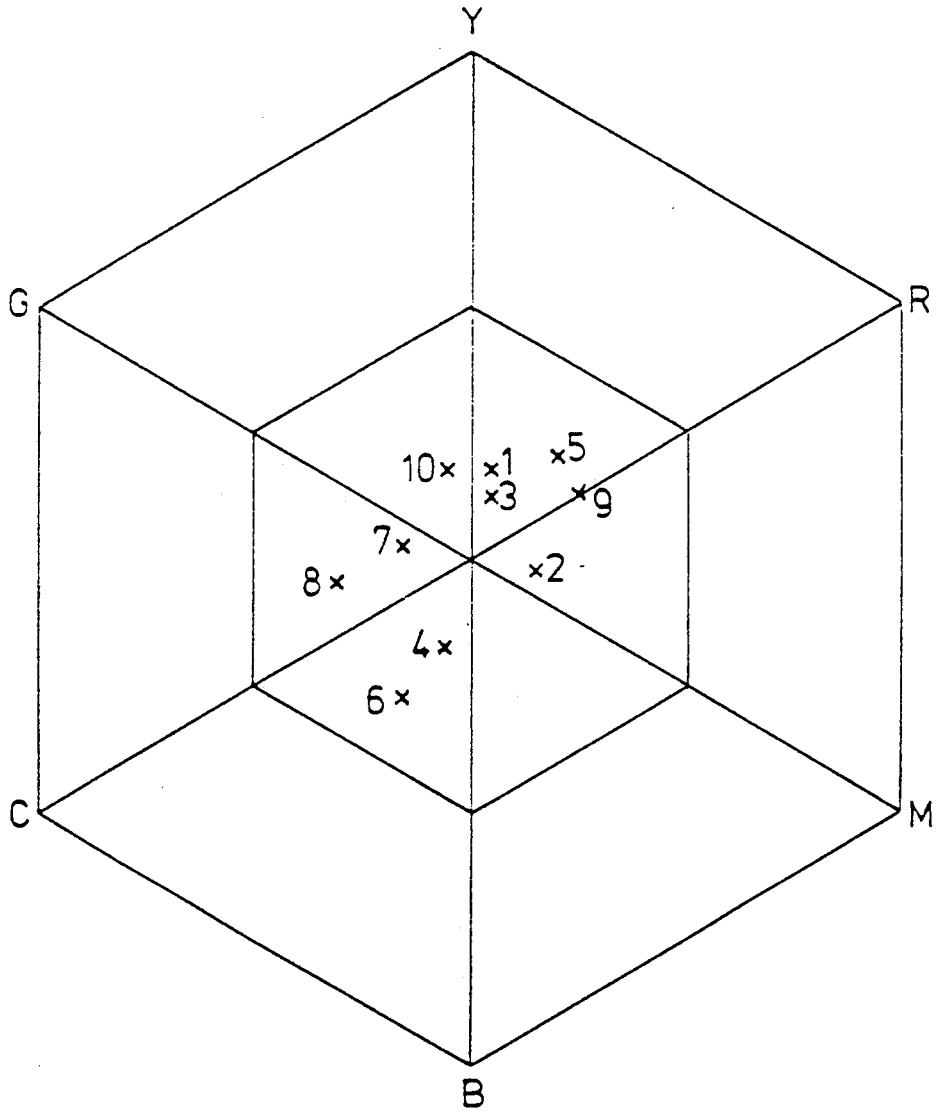
FIGS. 7, 8 and 9 are trilinear diagrams recording density in reproduction.
Figure 8:
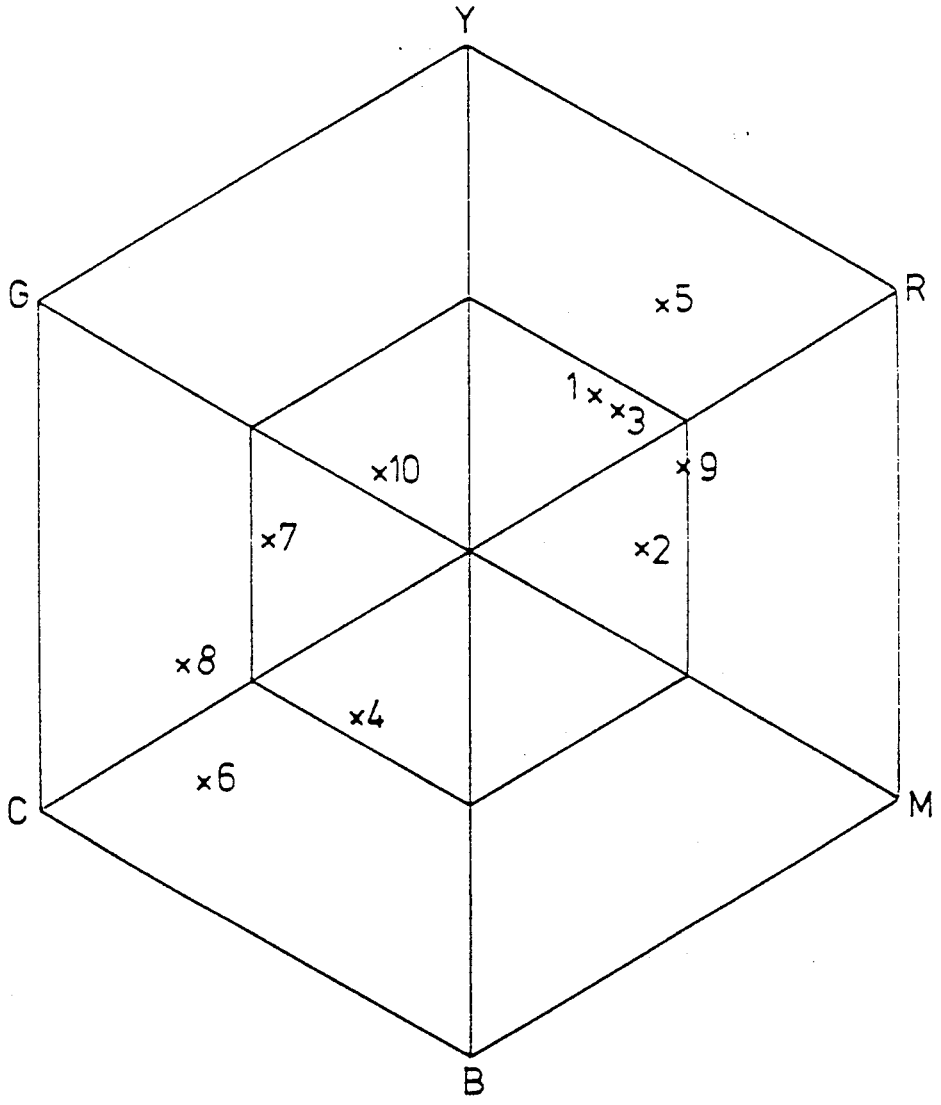
Figure 9:
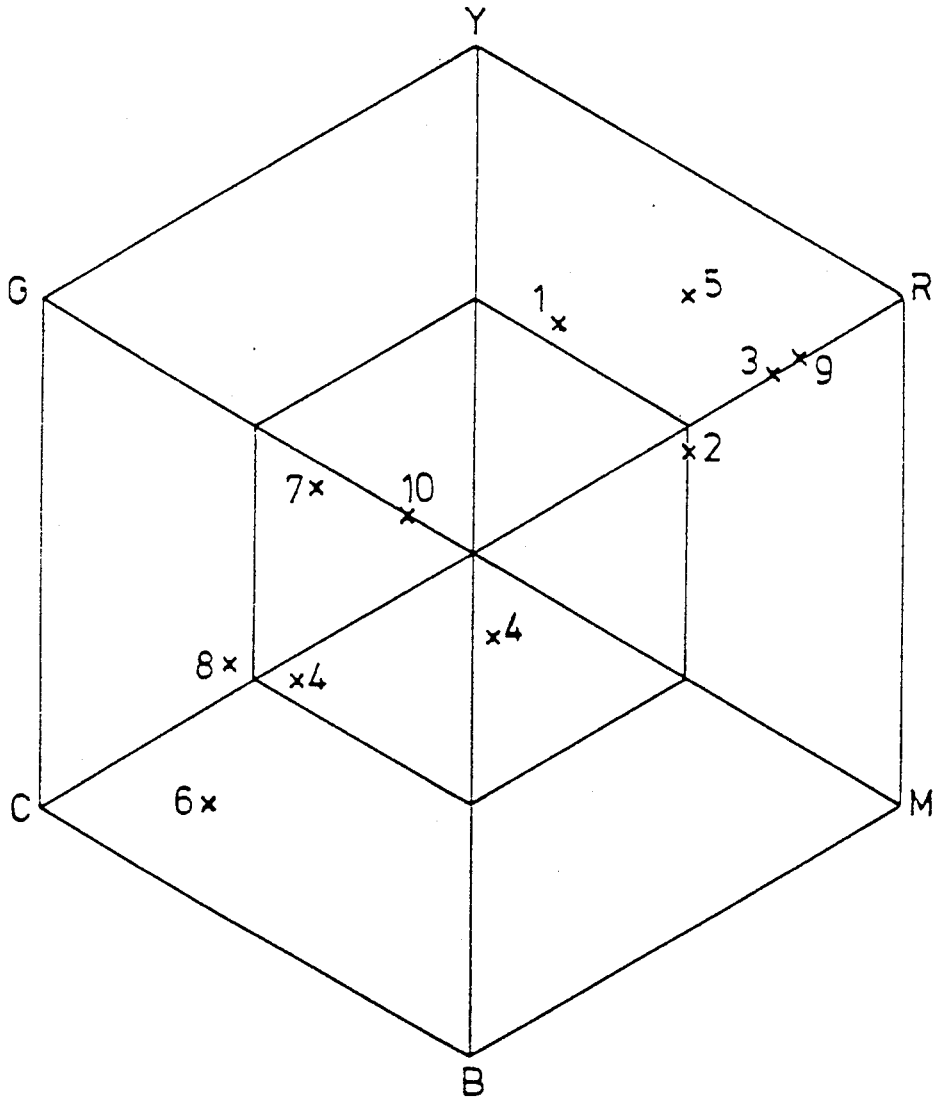

The three materials were exposed behind a graduated grey wedge and were processed on 10 days with an interval of 3 days in between (samples 1–10) in a development machine of the Kodacolor Dual-Strand Film Processor, Model 2, type in accordance with the processing guidelines described in Process C 42 Manual, January 1984, Eastman Kodak Company. The differences in density in the reproduction of a neutral subject of average lightness $D_{y\text{-}mg}$ and $D_{cy\text{-}mg}$ with $D_{mg}=1.2$ were then recorded in a trilinear diagram in accordance with German Standard DIN 4522 (FIGS. 7, 8 and 9). It can cleanly be seen from the Figures that the density scatter obtained on the ten test days is far narrower in the case of the combination according to the invention (FIG. 7) than in the case of the comparison materials (FIGS. 8 and 9). The nearer the individual values lie to the coordinate center point, the better the samples obtained.

MR

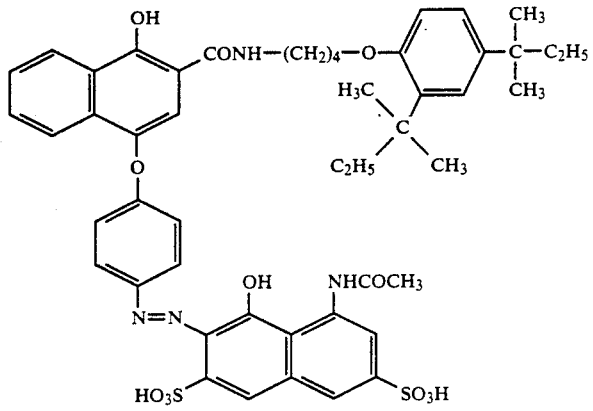

DC

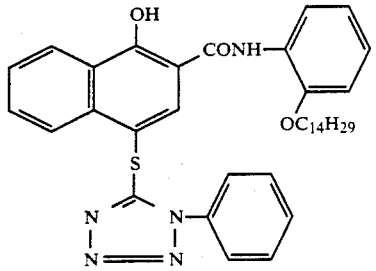

DIR-1

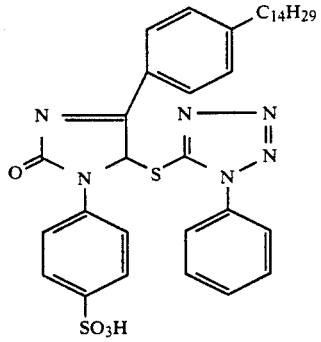

M

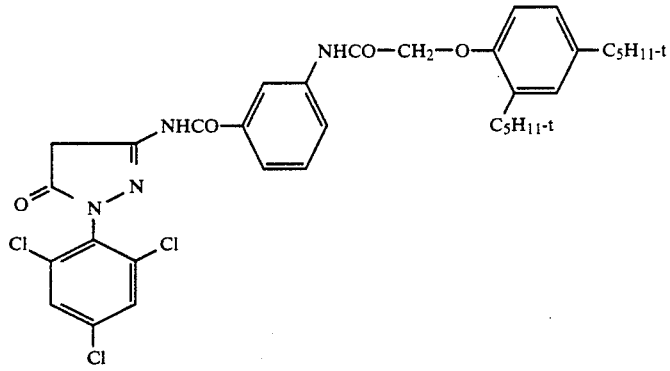

-continued

DM

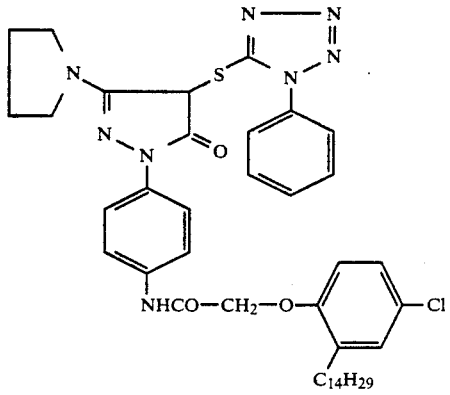

MG

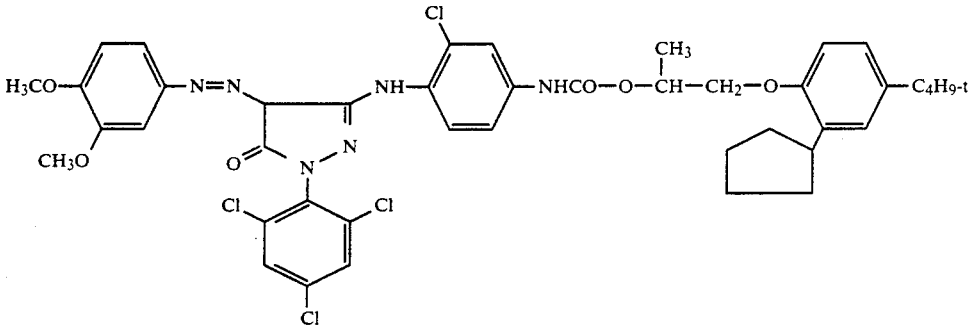

Y

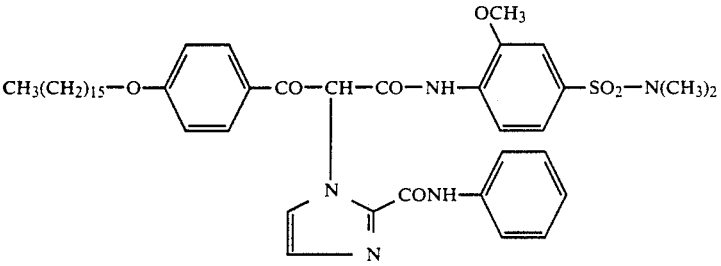

UV-1

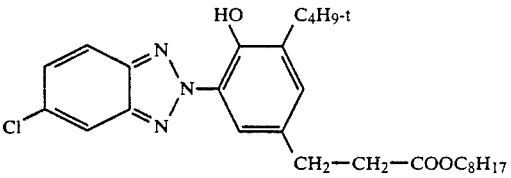

I claim:

1. A photographic recording material comprising at least one photosensitive silver halide emulsion layer and, associated therewith, a cyan coupler corresponding to formula I

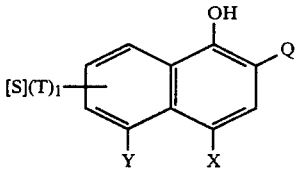

in which

Q is a 5-, 6-, or 7-membered heterocyclic radical containing at least one hetero atom selected from the group consisting of O, S, N and P;

T is a substituent which, when it is in the 6-position of the naphthol ring, can form a fused heterocyclic ring with Y;

l is 0, 1, 2 or 3;

X represents H or a group releasable during color coupling which is capable of forming a fused heterocyclic ring with Y;

Y represents —Z—$R^1$ or —NH—$R^2$;

Z represents —O—, —$S(O)_m$— or —$SO_2$—NH—;

m is 0, 1 or 2;

$R^1$ represents H, $CF_3$, alkyl, aryl or a heterocyclic radical;

$R^2$ represents H or a monofunctional radical containing at least one carbon atom which is capable of forming a fused heterocyclic ring with X or with T (in the 6-position of the naphthol ring).

2. A recording material as claimed in claim 1, characterized in that it contains a naphtholic cyan coupler corresponding to formula I, in which Y is an acylamino group.

3. A recording material as claimed in claim 1 or 2, characterized in that it contains a naphtholic cyan coupler corresponding to formula I, in which Q represents a 5- or 6-membered heterocyclic ring attached to the naphthol ring by a ring carbon atom.

* * * * *